US009206972B1

(12) United States Patent
Clifford

(10) Patent No.: US 9,206,972 B1
(45) Date of Patent: Dec. 8, 2015

(54) COMPACT LED DEVICE WITH COOLING FAN

(71) Applicant: Scott Clifford, Mesa, AZ (US)

(72) Inventor: Scott Clifford, Mesa, AZ (US)

(73) Assignee: LEDLab, LLC, Mesa, AZ (US)

( * ) Notice: Subject to any disclaimer, the term of this patent is extended or adjusted under 35 U.S.C. 154(b) by 220 days.

(21) Appl. No.: 13/938,093

(22) Filed: Jul. 9, 2013

Related U.S. Application Data

(63) Continuation-in-part of application No. 13/908,690, filed on Jun. 3, 2013.

(60) Provisional application No. 61/756,729, filed on Jan. 25, 2013, provisional application No. 61/802,406, filed on Mar. 16, 2013.

(51) Int. Cl.
*F21V 29/02* (2006.01)

(52) U.S. Cl.
CPC ..... *F21V 29/022* (2013.01); *F21V 29/02* (2013.01)

(58) Field of Classification Search
CPC ..... F21V 29/002; F21V 29/02; F21V 29/20; F21V 29/40; F21V 29/60; F21V 29/67; F21V 29/677
See application file for complete search history.

(56) References Cited

U.S. PATENT DOCUMENTS

| | | | | |
|---|---|---|---|---|
| 8,070,324 | B2 * | 12/2011 | Kornitz et al. | 362/294 |
| 8,858,040 | B2 * | 10/2014 | Rodriguez | 362/373 |
| 2010/0181833 | A1 * | 7/2010 | Wu | 307/36 |
| 2011/0037387 | A1 * | 2/2011 | Chou et al. | 315/35 |
| 2012/0098434 | A1 * | 4/2012 | Sondericker, III | 315/113 |
| 2014/0167615 | A1 * | 6/2014 | Lai | 315/117 |

* cited by examiner

*Primary Examiner* — Jung Kim
(74) *Attorney, Agent, or Firm* — Booth Udall Fuller, PLC

(57) ABSTRACT

A light emitting diode (LED) light bulb device can comprise a semiconductor chip comprising an input coupled to an AC power supply and a plurality of DC power outputs, a plurality of banks of LEDs coupled to the plurality of DC power outputs, and a fan coupled in parallel with a first of the plurality of banks of LEDs. The fan can be coupled to the first bank of LEDs through a filter comprising a diode, a resistor, and a capacitor. The capacitor can be coupled in parallel with the fan and be configured to supply a voltage to the fan while the plurality of banks of LEDs are alternately receiving power. The LED light bulb device can further comprising a WiFi receiver and include a height in a range between 2.5-6.875 centimeters and include a volume small enough to be enclosed in a standard j-box housing.

18 Claims, 4 Drawing Sheets

COMPACT LED DEVICE WITH COOLING FAN

CROSS REFERENCE TO RELATED APPLICATIONS

This application is a continuation-in-part of U.S. application Ser. No. 13/908,690 entitled "FAN COOLED LED LIGHT AND HOUSING" to Clifford, which was filed on Jun. 3, 2013, and claims the benefit of U.S. Provisional Patent Application 61/756,729, entitled "FAN COOLED LED LIGHT, HOUSING, AND POWER SUPPLY CIRCUIT" to Clifford, which was filed on Jan. 25, 2013 and also claims the benefit of U.S. Provisional Patent Application 61/802,406 entitled "FAN COOLED LED LIGHT AND HOUSING" to Clifford, which was filed on Mar. 19, 2013, the contents of all of which are hereby incorporated by this reference.

TECHNICAL FIELD

Embodiments of the present disclosure relate to the field of light emitting diode (LED) devices.

BACKGROUND

LED devices, in addition to producing light, also produce heat. Excess heat generated during LED operation can cause the LED device to fail. Accordingly, LED devices often include heat sinks that are used to dissipate heat and prevent LED failure. Heat sinks can be fixed and made of metal or other thermally conductive material that conduct heat away from the LED device. Alternatively, heat sinks can be moveable and circulate a fluid around LED elements containing excess heat (e.g. a fan that circulates air around the LED device) so that the fluid conducts excess heat away from the LED device.

Most LED lights in the industry include an alternating current to direct current (AC/DC) convertor. FIG. 1A is a schematic diagram that shows an embodiment of an LED device 20, as known in the art, which comprises an AC/DC convertor 10 including a line input 12 and a neutral input 14. The line and neutral inputs, 12 and 14 respectively, receive a standard AC voltage, such as 120 volts from a standard US electrical socket, and convert the AC voltage to a desired DC voltage, such as 4 volts, 12 volts, or any other desired voltage. As shown in FIG. 1A, a number of LEDs 16 are coupled to AC/DC convertor 10 to receive the desired DC voltage. Additionally, FIG. 1A shows fan 18 is coupled to line input 12 and neutral input 14 to receive an AC voltage to power the fan for cooling LED device 20 and dissipate heat generated by LEDs 16. In an embodiment, fan 18 can be an AC powered fan that receives AC power by being connected to input line 12 and neutral input 14. Alternatively, fan 18 can be a DC powered fan that includes an AC/DC convertor within fan 18 itself, such that fan 18 is connected to the same AC line voltage as AC/DC convertor 10.

FIG. 1B is a schematic diagram that shows an embodiment of an LED device 22, as known in the art, which is similar to LED device 20 from FIG. 1A. LED device 22 differs from LED device 20 by inclusion of DC fan 24 that is connected to AC/DC convertor 10 at first output 26 of the convertor, while LEDs 16 are connected to AC/DC convertor 10 at second output 28. Accordingly, a single AC/DC converter 10 serves to provide a DC power source to both DC fan 24 and LEDs 16.

SUMMARY

A need exists to provide a compact, simple, efficient, and cost effective LED light bulb device. Accordingly, in an aspect, an LED light bulb device can comprise a semiconductor chip comprising an input coupled to an AC power supply and further comprising a plurality of DC power outputs. A plurality of banks of LEDs can be coupled to the plurality of DC power outputs. A fan can be coupled in parallel with a first of the plurality of banks of LEDs.

The LED light bulb device can further comprise the fan being coupled to the first bank of LEDs through a filter comprising a diode, a resistor, and a capacitor. The capacitor can be coupled in parallel with the fan and can be configured to supply a voltage in a range of 11.8-12.2 volts to the fan while the plurality of banks of LEDs are alternately receiving power from the semiconductor chip. The LED light bulb device can further comprise a WiFi receiver. The LED light bulb device can include a height in a range between 2.5-6.875 centimeters and includes a volume small enough to be enclosed in a standard j-box housing. The semiconductor chip can be configured to dim the LEDs. A speed of the fan can be proportional to a brightness of the LEDs.

In another aspect, an LED light bulb device can comprise an input configured to receive an AC power supply. A semiconductor chip can be coupled to the input and can further comprise an output configured to supply DC power. An LED can be coupled to the output of the semiconductor chip. A fan can be coupled in parallel with the LED.

The LED light bulb device can further comprise the LED being coupled to the output of the semiconductor chip as part of an array of LEDs comprising a number of banks of LEDs. The banks of LEDs can be configured to alternately receive power from the semiconductor chip. The semiconductor chip can vary a load and a combination of the banks of LEDs in series or parallel to produce a power factor in a range of 0.9-1.0. The LED light bulb device can further comprise a WiFi receiver. The LED light bulb device can include a height in a range between 2.5-6.875 centimeters and can include a volume small enough to be enclosed in a j-box housing. The LED light bulb device can further comprise a housing comprising a form of a PAR30 case. The fan can be coupled to the LED through a filter, and the filter can be disposed within the fan.

In yet another aspect, a method of providing an LED light bulb device can comprise transmitting AC power to a semiconductor chip, transmitting DC power from the semiconductor chip to a first bank of LEDs and not a second bank of LEDs, transmitting DC power from the semiconductor chip to the second bank of LEDs and not the first bank of LEDs, and operating a fan at a speed proportional to a brightness of the first and second banks of LEDs.

The method of providing the LED light bulb device can further comprise operating the fan by transmitting DC power from the semiconductor chip through the first bank of LEDs to the fan, and operating the fan by transmitting DC power from the first bank of LEDs through a filter to the fan. The method of providing the LED light bulb device can further comprise receiving a signal from a WiFi receiver, and adjusting a brightness of the first and second bank of LEDs based on the signal.

DETAILED DESCRIPTION

Embodiments in the disclosure provide a compact, simple, efficient, and cost effective LED light bulb device comprising a fan for dissipating heat generated by a plurality of LEDs.

In the following description, numerous specific details are set forth, such as specific configurations, sizes, compositions, and processes, in order to provide a thorough understanding of the disclosure. In other instances, well known aspects have not been described in particular detail in order to not unnecessarily obscure the disclosure. Furthermore, it is to be understood that the various embodiments shown in the FIGs. are illustrative representations and are not necessarily drawn to scale.

The terms "over," "under," and "between," as used herein, refer to relative positions of one feature with respect to other features. One feature deposited or disposed above, below, over, or under another feature may be directly in contact with the other feature or may have one or more intervening features. One feature deposited or disposed between features may be directly in contact with the features or may have one or more intervening features. A first feature "on" a second feature may be directly in contact with the second feature or may have one or more intervening features.

Figure 2A:
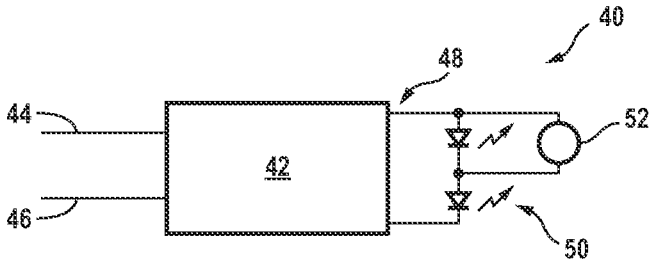
FIGS. 2A and 2B are schematic diagrams that illustrate LED devices comprising fans.

FIG. 2A is a schematic diagram that shows an embodiment of an LED light bulb device or LED device 40 according to an embodiment of the present disclosure. LED device 40 includes an AC/DC convertor further comprising an AC LED Driver integrated circuit (IC) or semiconductor chip 42. AC LED Driver IC 42 includes a line input 44 and a neutral input 46. The line input 44 and neutral input 46 can receive a standard AC voltage, such as 120 volts from a standard US electrical socket. AC LED Driver IC 42 converts the AC voltage to a desired DC output, such as 4 volts, 12 volts, or any other desired voltage, at output 48. LED Driver IC 42 converts the AC voltage across inputs 44 and 46 to a DC voltage at output 48 by employing a bank switching scheme that effectively "chops up" the AC input signal by processing discrete portions of the AC signal with respect to a time domain of the signal. By using the "chopped" AC signal from inputs 44 and 46, LED Driver IC 42 functionally replaces a much larger number of hardware components that might otherwise be used to accomplish an AC/DC conversion such as is required by a conventional AC/DC converter. Specifically, a single semiconductor chip can replace on the order of 50 or more components that would be required by a conventional AC/DC converter to provide similar functionality, thereby greatly simplifying the circuitry for LED device 40. As a non-limiting example, LED Driver IC 42 may include, without limitation, such chips as the chip of part number DT3001A/B by Digital Media Bridge Technology Co., Ltd. (DMB). DMB chip DT3001A/B is used, for example, by SEOUL Semiconductor as part of a bank switching scheme that effectively "chops up" an AC input signal to provide a desired output signal to an array or plurality of LEDs as used in Acriche Semiconductor Eco Lighting, such as the Acriche 4W, 8W, and 12W Acriche 2 modules. Use of bank switching for an LED lighting module is disclosed in U.S. Pat. No. 7,081,722 to Huynh, et al, titled "LIGHT EMITTING DIODE MULTIPHASE DRIVER CIRCUIT AND METHOD," as well as U.S. Pat. No. 7,439,944, to Huynh, et al, titled "LIGHT EMITTING DIODE MULTIPHASE DRIVER CIRCUIT AND METHOD," the entirety of the disclosures of which are incorporated herein by this reference.

Advantageously, use of AC LED Driver IC 42 in place of a conventional AC/DC convertor comprising numerous hardware components also increases reliability of the AC/DC conversion process. For example, conventional AC/DC convertors may include buck convertors, boost convertors, buck boost converters, H Bridge converters, SEPIC converters, Flyback converters, and a number of capacitors, transformers and inductors, each of which includes a functional life-time. Elements of a conventional AC/DC convertor can fail after a period of normal use also causing the convertor to fail. For example, conventional AC/DC convertors can receive repeated spikes in voltage during normal operation. The spikes in voltage can be reduced or smoothed for the convertor by capacitors, which can fail after receiving repeated spikes in voltage. Thus, by using AC LED Driver IC 42 in place of a conventional AC/DC convertor as part of LED device 40, a simpler, more reliable, and less expensive solution is available.

Figure 1A:
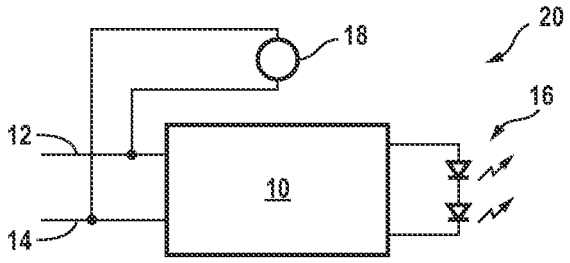
FIG. 1A (PRIOR ART)
FIGS. 1A and 1B are schematic diagrams that illustrate LED devices comprising fans as known in the prior art.
Figure 1B:
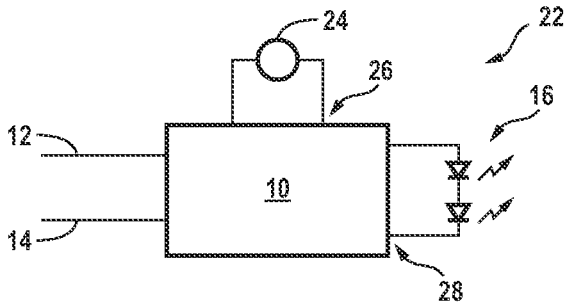
FIG. 1B (PRIOR ART)

FIG. 2A further shows a number of LEDs 50 are coupled to AC LED Driver IC 42 at output 48 to receive a desired DC voltage for powering LEDs 50. LEDs 50 may be a single LED or a plurality of LEDs arranged in an array comprising multiple banks of LEDs connected in series or in parallel, as discussed in greater detail below with respect to FIG. 3. Additionally, FIG. 2A shows a DC powered variable speed fan 52 that is coupled to output 48 of AC LED Driver IC 42 and is further coupled in parallel with at least one LED 50. The design of LED device 40 is conducive to the use of DC powered fans, which are typically commercially available as fans with a longer service lives than commercially available AC fans. In an embodiment, fan 52 is a fan produced by Sunon, Inc. The design of LED device 40 advantageously provides DC power for both LEDs 50 and fan 52 using the same AC LED Driver IC 42; thereby increasing efficiency by eliminating the redundancy of multiple AC/DC convertors for a single LED device, such as may be required by the design illustrated in FIG. 1A. Additionally, by coupling fan 52 in parallel with LEDs 50, instead of coupling the fan at a separate output of an AC LED Driver IC as shown in FIG. 1B, the voltage of fan 52 may vary as a voltage of LEDs 50 varies. A voltage to LEDs 50 may vary to increase a brightness or amount of light emitted by the LEDs. For example, LEDs 50 may be tied to a dimmer or have a dimmer functionality such that as voltage is increased a brightness of LEDs 50 is also increased to accommodate user preference. When fan 52 is coupled in parallel with LEDs 50, a voltage to variable speed fan 52 may also vary, to increase or decrease a speed at which the fan operates. For example, as the brightness of LEDs 50 is varied, such as by a dimmer, because LEDs 50 and variable speed fan 52 are coupled in parallel and share the same voltage, the speed of fan 52 varies directly with a brightness of LEDs 50. Advantageously, the increased brightness and heat from LEDs 50 is directly related to the speed of fan 52 and an amount of heat dissipated from LED device 40 by the fan so that the more heat is generated by LEDs 50, the more heat is dissipated by fan 52. Significantly, the direct relationship between heat generated by, and heat conducted away from, LED device 40 results from connecting LEDs 50 and fan 52 in parallel without the additional expense, complexity, and cost of adding additional components or circuitry to the LED device. Thus, the functionality of controlling the speed of fan 52 to accommodate changing thermal conditions of LEDs 50 may be "free" because variation of fan speed can operate without any circuitry or components in addition to those used for the operation of LEDs 50.

Figure 2B:
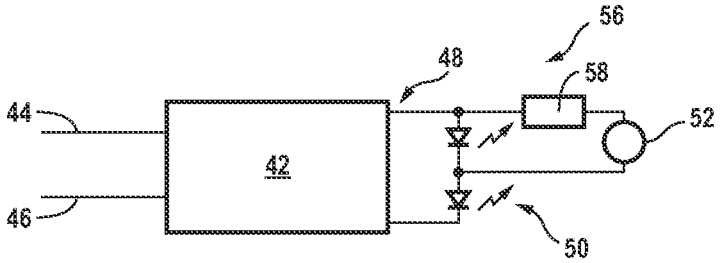
Figure 3:
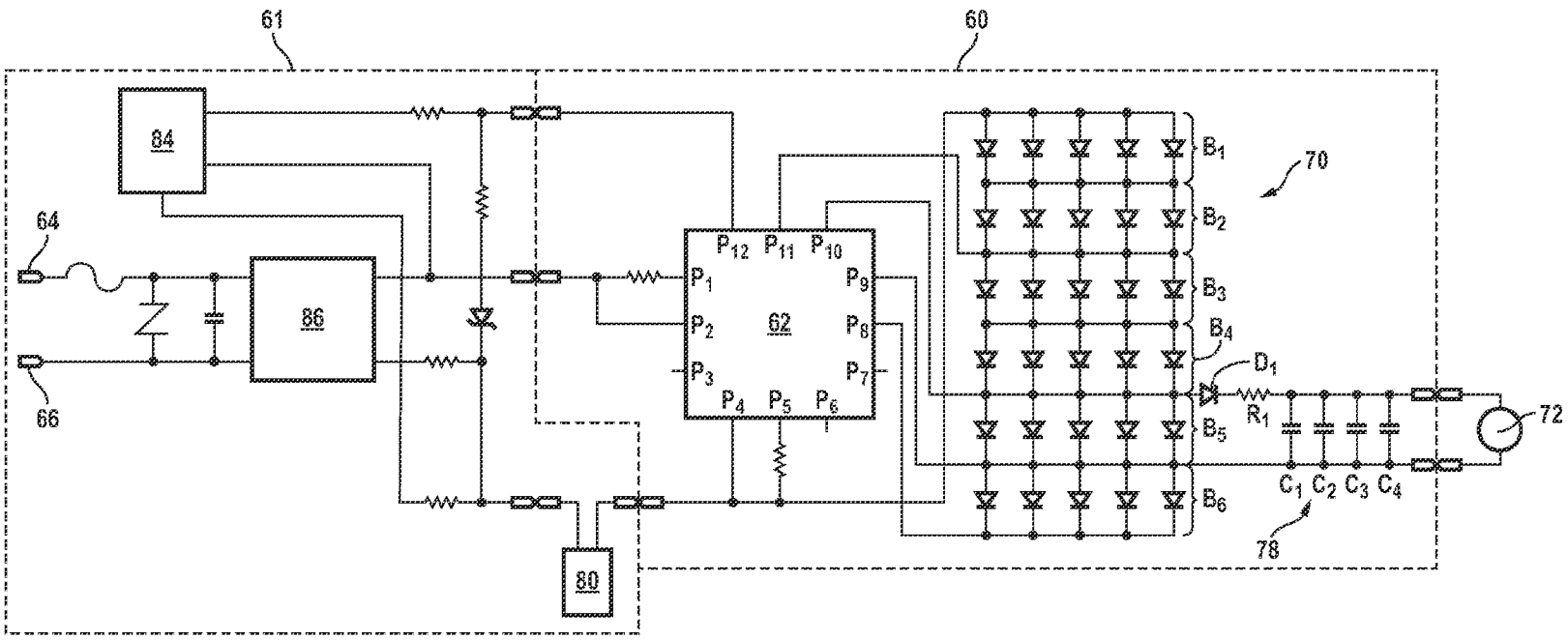
FIG. 3 is a schematic diagram that illustrates additional detail of an LED device comprising a fan.

FIG. 2B is a schematic diagram that shows an embodiment of an LED light bulb device or LED device 56 similar to LED light bulb device or LED device 40 from FIG. 2A. LED device 56 differs from LED device 40 by inclusion of optional filter 58. Filter 58 may include a number of capacitors and provides a stable voltage to fan 52 that may reduce or effectively eliminate undesired ripple effects and may also provide a voltage to fan 52 different from the voltage provided to LEDs 50, if desired. In one embodiment, a voltage of between 11.8-12.2 V may be used depending upon the fan being used for the design. However a different voltage could equivalently be used for a different fan, or if the forward voltage of the LEDs used is changed. Those of ordinary skill in the art will readily understand how to modify FIG. 3 is a schematic diagram that shows an embodiment of an LED circuit module 60 coupled to circuitry 61 and fan 72 in an arrangement similar to LED light bulb device or LED device 56 from FIG. 2B. LED circuit module 60 includes an AC/DC convertor further comprising an AC LED Driver IC, semiconductor chip, or IC 62 similar to AC LED Driver IC 42. IC 62 may be coupled to a line input 64 and a neutral input 66 that provide power for LED circuit module 60. Line input 64 and neutral input 66 may receive a standard AC voltage, such as 120 volts from a standard US electrical socket. IC 62 converts the AC voltage to a desired DC output, such as 4 volts, 12 volts, or any other desired voltage, at a number of output interconnects or pins. IC 62 may include any number of input/output pins or interfaces, and in a non-limiting embodiment comprises twelve pins, P1 to P 12. As described above with respect to AC LED Driver IC 42, IC 62 may convert the AC voltage across inputs 64 and 66 to a DC voltage by employing a bank switching scheme that effectively "chops up" the AC input signal by processing discrete portions of the AC signal with respect to a time domain of the signal. By using the "chopped" AC signal from inputs 64 and 66, LED Driver IC 62 functionally replaces a much larger number of hardware components that might otherwise be used to accomplish an AC/DC conversion such as is required by a conventional AC/DC converter. Specifically, a single semiconductor chip may replace on the order of 50 or more components that would be required by a conventional AC/DC converter to provide similar functionality, thereby greatly simplifying the circuitry for LED circuit module 60. As indicated above, IC 62 may include the chip of part number DT3001A/B by DMB that is used by SEOUL Semiconductor as part of its Acriche Semiconductor Eco Lighting hardware. Advantageously, use of IC 62 in place of a conventional AC/DC convertor comprising numerous hardware components also increases reliability of the AC/DC conversion process.

FIG. 3 further shows a number of LEDs 70 are arranged as a grid or array comprising a number of banks or rows B1 to B6, although any number of banks or rows comprising LEDs 70 arranged in series or parallel may be formed. One or more banks B1 to B6 of LEDs 70 are coupled to a number of pins P1-P12 of IC 62 such that LEDs 70 are configured to alternately receive a desired DC voltage from IC 62 for powering LEDs 70. For example, banks B1 and B2 may be coupled to P4, P5, and P11 of IC 62, banks B3 and B4 may be coupled to P10 and P11 of IC 62, bank B5 may be coupled to P9 and P10 of IC 62, and bank B6 may be coupled to P8 and P9 of IC 62. By controlling an amount and time for which the DC voltage is alternatingly applied across the various pins of IC 62, banks of LEDs 70 are alternately illuminated. While LEDs 70 are shown in FIG. 3 as organized in parallel rows or banks, LEDs 50 may also be serially arranged and/or packaged in groups that appear to be single lights, which are in reality, composed of a group or number of LEDs 50. In an embodiment, each bank of LEDs may be independently controlled by IC 62, which allows for more control over the operation of LEDs 70 than would otherwise be available with a more complex AC/DC conversion circuit that did not use an IC like IC 62. Because the banks of LEDs 70 are alternately turned on and off, during normal operations, an entirety of the lights is not on at a same time. However, the switching on and off of LEDs 70 may occur so quickly that a user does not perceive any flickering or perceive that LEDs 70 are being turned on and off, and instead perceives that the entirety of LEDs 70 are continuously activated or on. By using IC 62 to vary an electrical load supplied to a combination of banks B1-B6, arranged in series or parallel, a high power factor can be achieved for LEDs 70 in banks B1-B6. As known in the art, a power factor is a dimensionless unit used to describe a ratio of: real power flowing to the electrical load/apparent power; wherein real power is a circuit's capacity for performing work and apparent power is the product of the current and voltage of the circuit. In an embodiment, a power factor in a range of 0.9-1.0 is achieved by using IC 62 as described above.

Additionally, FIG. 3 shows a DC powered variable speed fan 72, similar to fan 52 from FIGS. 2A and 2B, coupled to bank B5 of LEDs 70 and further coupled to pins P9 and P10 of IC 62. By coupling fan 72 in parallel with at least one LED 70 the design of LED circuit module 60 advantageously provides DC power for both LEDs 70 and fan 72 using the same IC 62; thereby increasing efficiency by eliminating the redundancy of multiple AC/DC convertors for a single LED device. Additionally, by coupling fan 72 in parallel with bank B5 of LEDs 70, the voltage of fan 72 may vary as a forward voltage to LEDs 70 varies. A voltage to bank B5 of LEDs 70 may vary to increase a brightness or amount of light emitted by the LEDs. For example, LEDs 70 may receive a voltage from IC 62 that varies to dim or brighten LEDs 70 to accommodate user preference. Because LEDs 70 are coupled in parallel with fan 72, a voltage to variable speed fan 72 may also vary, to increase or decrease a speed at which the fan operates. For example, as the brightness of LEDs 70 is varied, because LEDs 70 and variable speed fan 72 are coupled in parallel and share the same voltage, the speed of fan 72 varies directly with a brightness of LEDs 70. Advantageously, the increased brightness and heat from LEDs 70 is directly related to the speed of fan 72 and an amount of heat dissipated from LED circuit module 60 by the fan so that when more heat is generated by LEDs 70, more heat is dissipated by fan 72. Significantly, the direct relationship between heat generated by, and heat conducted away from, LED circuit module 60 results from coupling LEDs 70 and fan 72 in parallel. Thus, the functionality of controlling the speed of fan 72 to accommodate changing thermal conditions of LEDs 70 may be "free" because variation of fan speed may operate without any additional, or only nominal, circuitry and components in addition to those used for the operation of LEDs 70. In an embodiment, the forward voltage of LEDs 70 may be approximately 24 volts and fan 72 is rated for 24 volts. In another embodiment, LEDs 70 may operate at a switching forward voltage peaking at a range of approximately 18-20 volts and a filter, such as filter 78 described in greater detail below, may be used to change the switching forward DC voltage from 18-20 volts to a DC voltage of approximately 12 volts.

Additionally, conventional LED light devices typically are made such that all the LEDs are connected or tied off together, whether in series or in parallel, so if an additional component such as fan 72 were coupled to the LEDs, the electrical current drawn by the component would reduce electrical current available for the connected group of LEDs, thereby sacrificing performance of the LEDs. To the contrary, by dividing the plurality of LEDs 70 into separate banks of LEDs that are independently controlled by IC 62, drawing power from one bank of LEDs, such as B5, does not adversely affect the performance of adjacent banks of LEDs in a significant or substantial way, although some nominal change in current and/or voltage may occur in surrounding banks of LEDs. Thus, the banks of LEDs may be arranged such that a voltage that would otherwise be supplied to a portion of the LEDs may be directed to power fan 72 by tapping off one bank of LEDs 70 to provide power to fan 72. Therefore, in a non-limiting exemplary embodiment, modification of IC62 for use with multiple banks of LEDs 70 requires a small number of parts (approximately 5-10 parts) and requires a small cost for parts (approximately $0.05-$0.20).

FIG. 3 further shows LED circuit module 60 may optionally include a filter 78, similar to filter 58 in FIG. 2B. Filter 78 is coupled between bank B5 of LEDs 70 and fan 72, and may optionally include a diode D1, a resistor R1, and a number of capacitors C1-C4. Resistor R1 may be used to adjust a voltage supplied to fan 72 as part of filter 78. The supply voltage to fan 72 is based on the forward voltage of LEDs 70 to which the fan is coupled, for example bank B5 of the LEDs. Accordingly, an operating voltage of LEDs 70 and fan 72 may be matched and may correspond one to another. For example, if the forward voltage of LEDs 70 is 24 volts, a 24 volt rated fan 72 may be selected. Similarly, LEDs operating at 12 volts may be paired with a 12 volt rated fan. In some embodiments, an optimal operating voltage for LEDs 70 will be different from an optimal operating voltage of fan 72, in which case allowance should be made for the differences in voltage by adjusting the voltage between LEDs and the fan by inserting a resistor, such as R1, between the LEDs and the fan. In a particular embodiment, LEDs 70 operate at a peak switching forward voltage in a range of approximately 18-20 volts and fan 72 is rated to operate at approximately 12 volts, so that filter 78 including resistor R1 is used to change the DC voltage of 18-20 volts at B5 of LEDs 70 to a voltage of about 12 volts at fan 72. In an embodiment, resistor R1 may have a resistance sized to meet the current requirements of the fan. In a particular embodiment, resistor R1 may have a value of about 150 ohms and is selected so the fan will see between 20 mA and 27 mA of average DC current. The current value needed is determined by the fan manufacture specifications. Thus, LED circuit module 60 may be designed to supply a particular voltage to fan 72, or fan 72 may be selected such that the fan will accommodate the voltage supplied to LEDs 70.

Filter 78 may also include a number of capacitors that ensure a constant or acceptable voltage is supplied to fan 72 while a voltage is intermittently and alternately supplied to banks B1-B6 of LEDs 70 by IC 62. Capacitors C1-C4 may be placed within fan 72 and integrally formed as part of a single unit, or alternatively, may be placed outside fan 72 and positioned elsewhere within LED circuit module 60, or within circuitry 61, such as when a size of the capacitors is too large to be accommodated within a housing of the fan. In an embodiment, filter 78 may include four capacitors, C1-C4, that each have a capacitance in a range of about 12-25 microfarads, and are connected in parallel with resistor R1 and fan 72. Because LEDs 70 are not all on at a same time, and fan 72 draws its power from only a portion or bank of the LEDs, fan 72 could, undesirably, receive only intermittent power and thus rapidly switch on and off as IC 62 alternately supplied power to banks B1-B6 of LEDs 70. Providing capacitors as part of filter 78 allows an electrical charge to be stored in the capacitors by drawing electrical current from a bank of LEDs when the bank of LEDs is receiving a voltage from IC 62. Then, when the bank of LEDs to which fan 72 is coupled is not receiving power from IC 62, the capacitors may release a portion of the stored charge to fan 72, such that fan 72 has a constant or sufficient voltage supply so that the fan may operate uninterrupted and continuously conduct heat from the array of LEDs 70 while IC 62 performs its bank switching.

Providing capacitors as part of filter 78 also allows a stable voltage to be provided to fan 72 by eliminating undesired ripple effects within LED circuit module 60. A ripple effect is the small unwanted residual periodic variation of the DC output of IC 62 that results from the input of an AC power source at inputs 64 and 66. The ripple effect is due to an incomplete suppression of the alternating waveform within IC 62. Thus the cycling of LED banks B1-B6 from the alternating voltage supply from IC 62 may cause a ripple effect from the cycling of banks B1-B6 and the turning on and off of LEDs 70. The presence of some ripple effect will not adversely affect operation of fan 72, and the fan will continue to operate in normal ranges. However, excessive ripples will decrease performance of fan 72, thereby reducing both an ability of the fan to transfer heat away from LEDs 70 and reducing an overall life of fan. As described above, inclusion of capacitors within filter 78 between fan 72 and a bank of LEDs serves to maintain a stable voltage, which eliminates excessive ripple effect and improves fan performance and increases fan lifetime.

FIG. 3 also shows additional circuitry 61 that may optionally be coupled to LED circuit module 60 and fan 72. Circuitry 61 may comprise a number of optional resistors, capacitors, diodes, and other devices according to the function and design of a final LED device. In an embodiment, circuitry 61 comprises a thermal switch or thermocouple 80. Thermal switch 80 operates as a cut off switch that will stop operation of LED circuit module 60 if too much heat accumulates within the LED device and threatens to overheat and or damage LEDs 70 or other components of the LED device. For example, if fan 72 breaks or ceases operation and the LED device begins to accumulate dangerous levels of heat, then thermal switch 80 will respond to the increased temperature of the LED device by stopping IC 62 from powering LEDs 70 such that excess heat dissipates and LED circuit module 60 is not damaged.

FIG. 3 further shows a WiFi module or interface 84 included as part of circuitry 61. WiFi module 84 is coupled to AC inputs 64 and 66 as well as to IC 62. In an embodiment, WiFi module 84 may include a WiFi module from Microchip (Roving Networks), part number RN-717. This WiFi module uses a separate microcontroller that may be programmed to interface with a WiFi home system or any other WiFi system. However, other WiFi modules from this and other manufacturers are sufficient for this and other embodiments. WiFi module 84 may be removably attachable to circuitry 61 such that the WiFi module is optionally attached, for example, by being snapped into place. WiFi module 84 can advantageously provide dimming functionality to LEDs 70 by controlling or providing input signals to IC 62 that allow for direct access to LEDs 70 through the WiFi interface. The WiFi interface can be accessed and controlled by a user through a computer, a portable handheld electronics device such as a phone or tablet, and through other suitable devices, thereby eliminating a need for dimmer modules previously used in the art.

While WiFi or radio connections have been previously put into lights, conventional lights with WiFi connections have included a total size or volume that was too large to fit within standard size ceiling junction boxes (j-boxes). For example, in the Unites States a standard round ceiling junction box includes a diameter in a range of about 5.0-8.44 centimeters (cm) (or about 2.0-3.375 inches) and a depth of about 2.5-6.875 cm (or about 1.0-2.75 inches) for a total interior volume of about 78-490 cubic centimeters (or 4.0-31.3 cubic inches). Thus, conventional lighting devices with WiFi control were suitable for applications involving can lighting, but had volumes that were prohibitive of use in smaller applications such as use in standard j-boxes as described above. To the contrary, some embodiments of disclosed LED circuit modules 60, circuitry 61 including WiFi module 84, and fan 72, taken together, are small enough to fit in a standard sized junction box while emitting as much light as would be emitted by a conventional 100 Watt incandescent bulb.

FIG. 3 further shows an electrical bridge 86 may optionally be included as part of circuitry 61. Bridge 86 may be coupled between inputs 64 and 66 and LED module circuit 60 to convert the alternating current (AC) power source to a direct current (DC) power source. Bridge 86 may comprise four diodes configured in a bridge configuration. Bridge 86 may be sized to meet the current requirements of the designed load, which in an embodiment, can be about 12-15 Watts. In another particular embodiment, a 500 mA part is used, which exceeds the lower required 90 mA and 125 mA.

Figure 4:
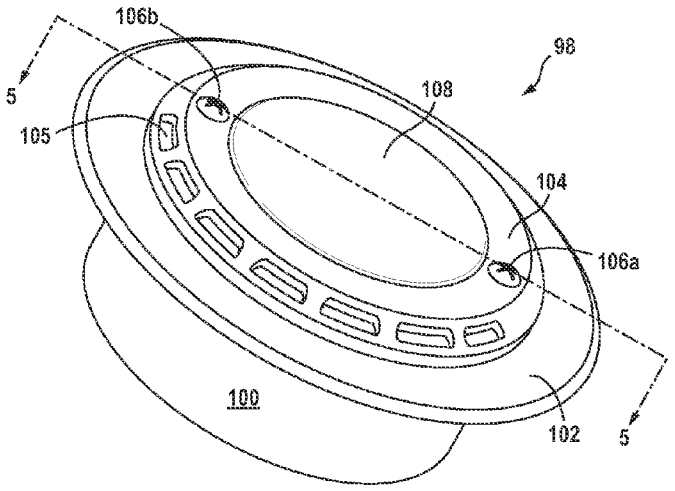
FIG. 4 is a perspective view of an embodiment of an LED device comprising a housing.

FIG. 4 shows a perspective view of LED device 98 comprising circuitry 61 and circuit module 60 described above with respect to FIG. 3 disposed within a standard sized ceiling j-box 100. A face plate 102 and a base plate 104 comprising vents 105 are disposed over and connected to j-box 100 with screws 106. A lens 108 is attached to base plate 104 and comprises a translucent material that allows passage of light generated by LEDs 70 to pass through the lens while the lens protects LEDs 70. Vents 105 in base plate 104 increase airflow and permit fan 72 to circulate air around LEDs 70 to cool LED circuit module 60 and LED device 98. By building LED circuit module 60 and circuitry 61 with a volume less than a volume of j-box 100, LED circuit module 60 may be installed in desired lighting applications by being disposed within j-box 100 rather than being housed within larger more expensive can lighting that requires additional effort, time, and expense for installation. By installing LED circuit module 60 in j-box 100 instead of in a can lighting fixture, LED circuit module 60 may be packaged to be much lighter than can lighting and also avoid direct exposure to higher attic temperatures, being instead exposed to cooler temperatures of a room the LED device is lighting, thereby improving thermal performance.

While FIG. 4 shows only a single LED device 98 comprising j-box 100, a number of LED devices 98 may be electrically connected in series or parallel to form a number of interconnected lighting devices, or a "daisy chain" of LED devices. Interconnected LED devices 98 may be used for lighting rooms and areas requiring more than a single unit and may operate as part of a larger lighting system.

Figure 5:
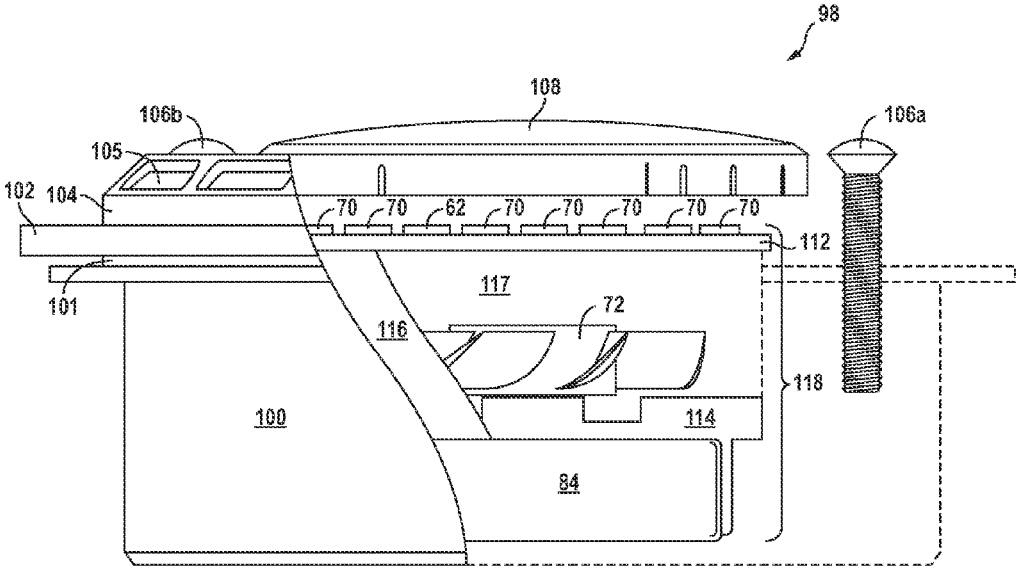
FIG. 5 in a cut away cross-sectional view of the embodiment of the LED device of FIG. 4.

FIG. 5 shows a cross-sectional view of LED device 98 taken along section line 5-5 shown in FIG. 4. The left side of FIG. 5 shows elements disposed at the exterior of LED device 98 that were shown previously in FIG. 4, such as j-box 100, face plate 102, base plate 104, screw 106, and lens 108. FIG. 5 further shows a flash mount insulator 101 disposed between j-box 100 and both face plate 102 and base plate 104. FIG. 5 further shows a cut-away view of LED device 98 by removal of a portion of j-box 100, flash mount insulator 101, face plate 102, and base plate 104 to reveal interior elements of LED device 98. The exterior elements of LED device 98 shown on the left side of FIG. 5 are removed from the right side of FIG. 5 to show features disposed within the LED device and internal to the exterior elements. For example, FIG. 5 shows LEDs 70 and IC 62 are mounted to a substrate 112 that may be disposed within j-box 100, over fan 72, over WiFi module 84, and below lens 108. Thus, light emitted from LEDs 70 can pass unobstructed through lens 108.

FIG. 5 also shows a shroud cover or housing base 114 disposed within j-box 100. Housing base 114 may be made of plastic, metal, fiberglass, ceramic, composite material, or other suitable material that provides a structural base to which fan 71 and WiFi module 84 may be connected. A printed circuit board (PCB) containing circuitry 61 may also be coupled or mounted to housing base 114 below fan 72.

LED device 98 further comprises a fan shroud or housing 116 that may be made of plastic, metal, fiberglass, ceramic, composite material, or other suitable material. Fan shroud or housing 116 is coupled to, and extends between, perimeter portions of substrate 112 and housing base 114. Housing 116 is disposed around fan 72 and forms a space or area 117 in which the fan can circulate air to cool LEDs 70 and LED device 98. Taken together, substrate 112 comprising IC 62 and LEDs 70, fan 72, housing base 114, and housing 116 form a module 118 that may have a height less than a height of j-box 100.

Figure 6:
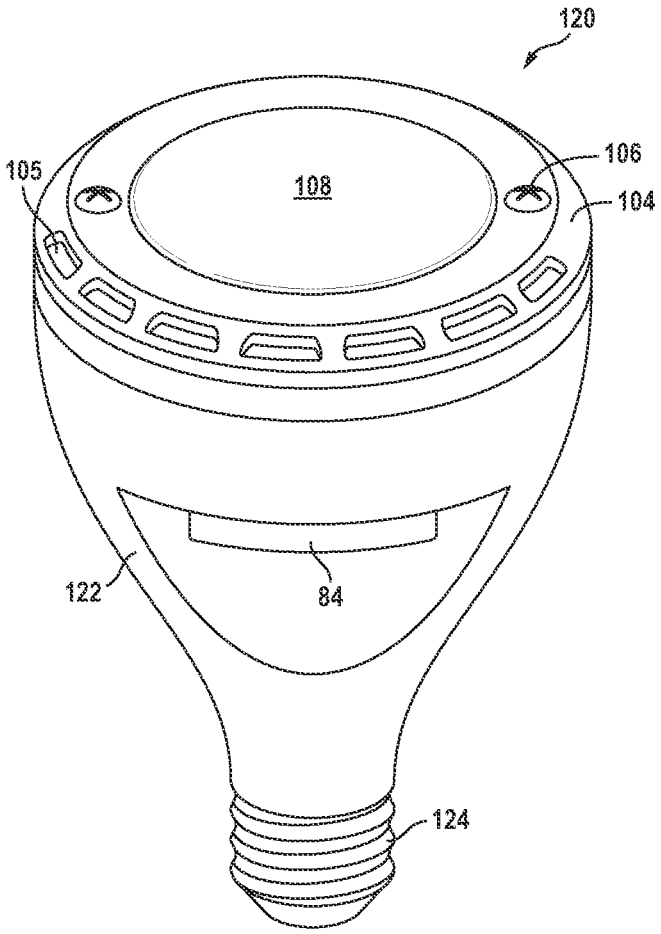
FIG. 6 is a perspective view of another embodiment of an LED device comprising a housing.

FIG. 6 shows a perspective view of an LED device 120 that is similar to LED device 98 shown in FIG. 4. Like LED device 98, LED device 120 may comprise circuit module 60, circuitry 61, and fan 72, disposed within a standard sized housing 122. Housing 122 may be made of plastic, metal, fiberglass, ceramic, composite material, or other suitable material. Housing 122 may contain or surround module 118, the module having a height less than a height of j-box 100. Housing 122 may be larger than, or enclose an area greater than, the area enclosed by housing 98 to match a shape, contour, or form factor or standard shaped or commercially available product, such as a Par 30 bulb. Because module 118 is smaller than j-box 100 and housing 122, the same module may be used in multiple different housings without modifying the shape and layout of the module. By using a single module design within multiple housings, greater efficiencies and lower costs may be achieved. Additional space created between module 118 and housing 122 may be shaped and used for air circulation and LED cooling. In an embodiment, housing 122 is shaped to expose at least a portion of WiFi module 84 at an exterior of LED device 120 for easy access that enables the optional addition and removal of the WiFi module.

FIG. 6 further shows LED device 120 may include a socket fitting 124 attached to an end of LED device 120 opposite lens 108. Socket fitting 124 may be made of metal or other conductive material or combination of materials. Socket fitting 124 may be threaded to be removably attached LED device 120 to a standard light socket configured to receive conventional light bulbs and provide a voltage or electrical power supply to circuit module 60.

Similar to FIGS. 4 and 5, LED device 120 of FIG. 6 includes a base plate 104 comprising vents 105, screws 106, and lens 108. Base plate 104 is disposed over and may be connected to housing 122 opposite socket fitting 124 with screws 106. A lens 108 may be coupled to base plate 104 and housing 122 and comprises a translucent material that allows passage of light generated by LEDs 70 while protecting LEDs 70. Vents 105 in base plate 104 increase airflow and permit fan 72 to circulate air around LEDs 70 to cool LED circuit module 60 and LED device 120.

While FIG. 6 shows only a single LED device 120, a number of LED devices may be electrically connected in series or parallel to form a number of interconnected lighting devices, or a "daisy chain" of LED devices. Interconnected LED devices 120 may be used for lighting rooms and areas requiring more than a single unit and may operate as part of a larger lighting system.

In the foregoing specification, various embodiments have been described. It will, however, be evident that various modifications and changes may be made thereto without departing from the broader spirit and scope set forth in the appended claims. The specification and drawings are, accordingly, to be regarded in an illustrative sense rather than a restrictive sense.

What is claimed is:

1. A light emitting diode (LED) light bulb device, comprising:

a semiconductor chip comprising an input coupled to an AC power supply and further comprising a plurality of DC power outputs;

a plurality of banks of LEDs coupled to the plurality of DC power outputs; and a fan coupled in parallel with a first of the plurality of banks of LEDs;

wherein the fan is coupled to the first bank of LEDs through a filter comprising a diode, a resistor, and a capacitor; and wherein the capacitor is coupled in parallel with the fan and is configured to supply a voltage in a range of 11.8-12.2 volts to the fan while the plurality of banks of LEDs are alternately receiving power from the semiconductor chip.

2. The LED light bulb device of claim 1, further comprising a WiFi receiver.

3. The LED light bulb device of claim 1, wherein the LED light bulb device includes a height in a range between 2.5-6.875 centimeters and includes a volume small enough to be enclosed in a standard j-box housing.

4. The LED light bulb device of claim 1, wherein the semiconductor chip is configured to dim the LEDs.

5. The LED light bulb device of claim 1, wherein a speed of the fan is proportional to a brightness of the LEDs.

6. A light emitting diode (LED) light bulb device, comprising:

an input configured to receive an AC power supply;

a semiconductor chip coupled to the input and further comprising an output configured to supply DC power;

an LED coupled to the output of the semiconductor chip; and a fan coupled in parallel with the LED;

wherein the LED coupled to the output of the semiconductor chip is part of an array of LEDs comprising a number of banks of LEDs; and wherein the banks of LEDs are configured to alternately receive power from the semiconductor chip.

7. The LED light bulb device of claim 6, wherein the semiconductor chip varies a load and a combination of the banks of LEDs in series or parallel to produce a power factor in a range of 0.9-1.0.

8. The LED light bulb device of claim 6, further comprising a WiFi receiver.

9. The LED light bulb device of claim 6, wherein the LED light bulb device includes a height in a range between 2.5-6.875 centimeters and includes a volume small enough to be enclosed in a j-box housing.

10. The LED light bulb device of claim 6, wherein the fan is coupled to the LED through a filter.

11. The LED light bulb device of claim 6, wherein the filter is disposed within the fan.

12. The LED light bulb device of claim 1, wherein at least the fan and semiconductor chip are enclosed within a housing, the LED light bulb device further comprising a lens disposed adjacent to the plurality of banks of LEDs.

13. The LED light bulb device of claim 12, wherein the banks of LEDs are disposed within the housing between the fan and the lens.

14. The LED light bulb device of claim 1, further comprising a housing surrounding the semiconductor chip, plurality of banks of LEDs and fan, the housing comprising a socket fitting at an end of the housing.

15. The LED light bulb device of claim 14, wherein the socket fitting is a threaded socket fitting.

16. The LED light bulb device of claim 6, wherein at least the fan and semiconductor chip are enclosed within a housing, the LED light bulb device further comprising a lens disposed adjacent to the plurality of banks of LEDs.

17. The LED light bulb device of claim 16, wherein the banks of LEDs are disposed within the housing between the fan and the lens.

18. The LED light bulb device of claim 6, further comprising a housing surrounding the semiconductor chip, plurality of banks of LEDs and fan, the housing comprising a socket fitting at an end of the housing.

* * * * *